US008179056B2

(12) United States Patent
Seguine

(10) Patent No.: US 8,179,056 B2
(45) Date of Patent: May 15, 2012

(54) SYSTEM AND METHOD FOR REMOTE CONTROL LIGHTING

(75) Inventor: Dennis Seguine, Monroe, WA (US)

(73) Assignee: Cypress Semiconductor Corporation, San Jose, CA (US)

( * ) Notice: Subject to any disclaimer, the term of this patent is extended or adjusted under 35 U.S.C. 154(b) by 707 days.

(21) Appl. No.: 12/238,758

(22) Filed: Sep. 26, 2008

(65) Prior Publication Data

US 2010/0079083 A1 Apr. 1, 2010

(51) Int. Cl.
*H05B 37/02* (2006.01)

(52) U.S. Cl. ..... 315/291; 345/173; 340/538.11

(58) Field of Classification Search ..... 340/531, 340/533, 534, 538, 538.11; 345/156, 173; 315/291, 307

See application file for complete search history.

(56) References Cited

U.S. PATENT DOCUMENTS 4,234,926 A * 11/1980 Wallace et al. ..... 702/188
5,059,871 A 10/1991 Pearlman et al.
5,471,119 A * 11/1995 Ranganath et al. ..... 315/307
6,388,396 B1 * 5/2002 Katyl et al. ..... 315/294
6,392,368 B1 5/2002 Deller et al.
6,822,555 B2 * 11/2004 Mansfield et al. ..... 340/538.11
7,014,336 B1 3/2006 Ducharme et al.
7,135,966 B2 * 11/2006 Becattini ..... 340/531

OTHER PUBLICATIONS

International Search Report of the International Searching Authority for Internationai Application No. PCT/US2009/058266 mailed Nov. 20, 2009; 2 pages.
The Written Opinion of the International Searching Authority for International Application No. PCT/US2009/058266 mailed Nov. 20, 2009; 4 pages.

* cited by examiner

*Primary Examiner* — Thuy Vinh Tran

(57) ABSTRACT

Remote lighting control methods, devices and systems are disclosed. One embodiment of the present invention pertains to a light device. The light device includes a light source for emitting light and a control circuit for setting an intensity level of the light source based on receipt of control data via a power line when the light device is electrically coupled to the power line. The control data is generated in response to user input to an input panel of a remote lighting control module for the light device. In addition, the light device comprises a unique address associated with a region on the input panel.

20 Claims, 6 Drawing Sheets

300

SYSTEM AND METHOD FOR REMOTE CONTROL LIGHTING

FIELD OF TECHNOLOGY

Embodiments of the present invention relate to the field of electronics. More particularly, embodiments of the present invention relate to a remote control lighting system.

BACKGROUND

A lighting control system includes a control device which controls electric lights for a building or residence. The lighting control system may also include one or more keypads or panel interfaces. These interfaces allow a user to control (e.g., turn on, turn off, dim, etc.) lights coupled to the control device. Additionally, the lighting control system may allow the user to control all the lights in the building or residence, not just in a single room.

SUMMARY

One embodiment of the present invention pertains to a light device which comprises a light source, a mechanism for coupling the light source to a light fixture and a control circuit for setting an intensity level of the light source in response to receipt of control data transmitted via a power line. The control data is generated in response to user input to a user interface of a remote lighting control module for the light source, and the light device includes a unique address associated with a region on the user interface.

Another embodiment of the present invention pertains to a lighting control system which comprises a capacitive sensing touch pad comprising a first button operable for remotely setting color and intensity and a second button representing an LED light device. The LED light device includes an address linked with the second button and a remote lighting control module coupled to the capacitive sensing touch pad. The remote lighting control module generates and forwards the address and control data associated with the color and the intensity information to the LED light device via a power line when a user interacts with the first button and the second button for remote controlling of the LED light device.

Yet another embodiment of the present invention pertains to a method for remotely controlling an LED light device via a power line which comprises generating control data for setting color and intensity information by processing user interaction with a first icon of a capacitive sensing touch pad. The method also comprises determining an address of the LED light device based on the user interaction with a second icon representing the LED light device, where the second icon is associated with the address of the LED light device. The method further comprises communicating the address and control data to the LED light device via the power line.

BRIEF DESCRIPTION OF THE DRAWINGS

Example embodiments are illustrated by way of example and not limitation in the figures of the accompanying drawings, in which like references indicate similar elements and in which.

Other features of the present embodiments will be apparent from the accompanying drawings and from the detailed description that follows.

DETAILED DESCRIPTION

Reference will now be made in detail to the embodiments of the invention, examples of which are illustrated in the accompanying drawings. While the disclosure will be described in conjunction with the embodiments, it will be understood that they are not intended to limit the disclosure to these embodiments. On the contrary, the disclosure is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Embodiments of a method, device and/or system are disclosed that may reduce the cost and labor of installing a lighting control system. By using a lighting control design which enables controlling of individual light units rather than their associated fixtures, such as sockets or switches, it may be possible to conveniently redesign the layout of the lighting control system by regrouping or repositioning the light units. Thus, embodiments include a light bulb with an intelligence to communicate with its control device via a power line when a user interacts with a touch pad processed by the control device. In one embodiment, the light unit may include a light bulb with a base component for attaching to a light fixture.

As illustrated herein, other embodiments pertain to methods, devices and systems that provide a way to add flexibility in modifying the control associations with lighting control system. Through utilizing an addressable LED light unit and a method and mechanism for remotely controlling the addressable LED light unit, the embodiments may provide a more robust, inexpensive and flexible lighting control system that are well suited for retrofitting existing buildings or homes that have conventional lighting wiring.

Figure 1:
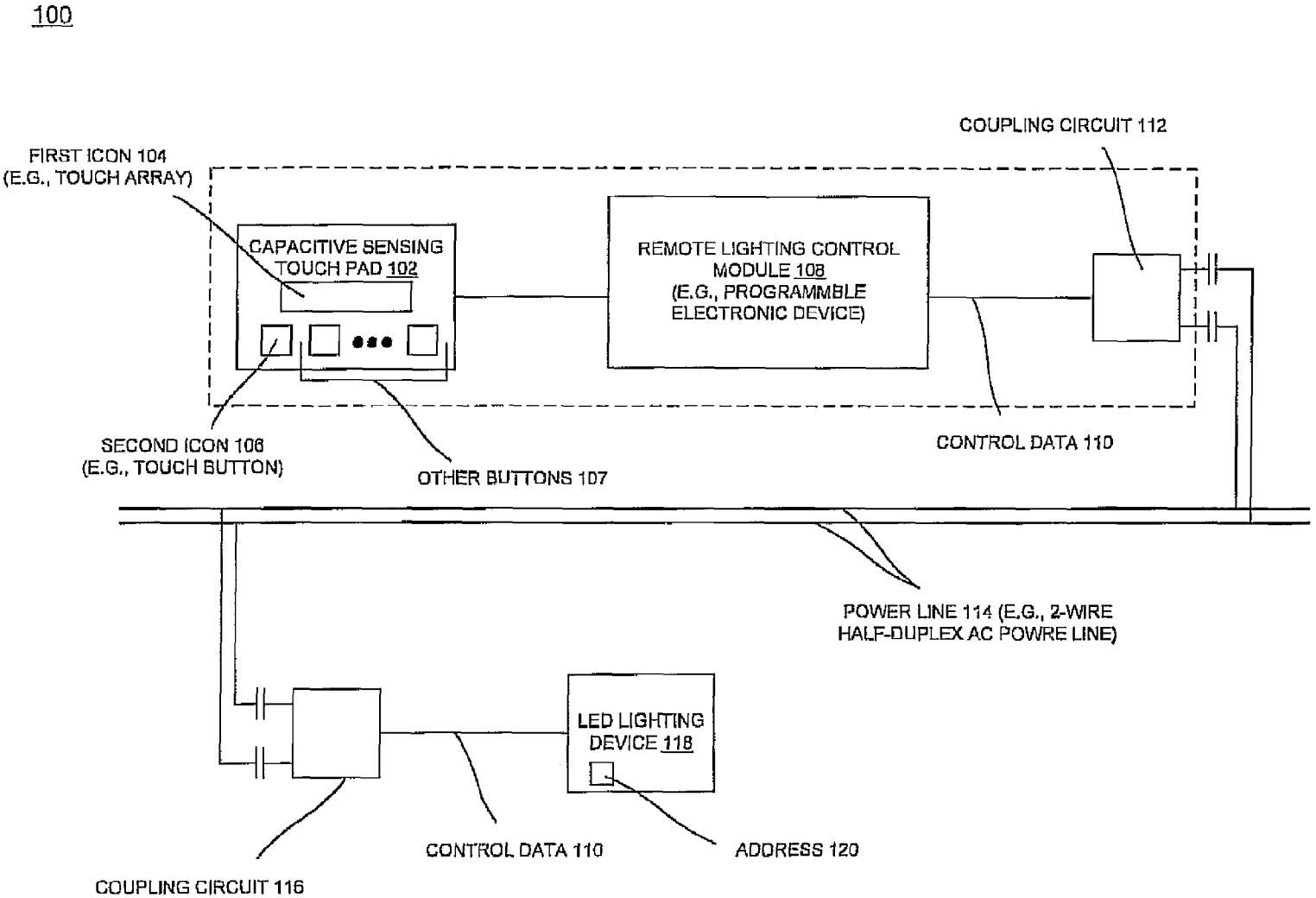
FIG. 1 illustrates a block diagram of components of an exemplary remote lighting control system, according to one embodiment.

FIG. 1 illustrates a block diagram of elements of an exemplary lighting control system 100, according to one embodiment. In FIG. 1, the lighting control system 100 comprises an input panel, which in one example may be a capacitive sensing touch pad 102, comprising a first icon 104 or button operable for remotely setting a color and an intensity of an LED lighting unit 118 (e.g., an attachment and control portion and an LED light bulb) and a second icon 106 representing the LED lighting unit 118. The capacitive sensing touch pad 102 also contains other icons 107 or buttons that are associated with other lighting units. The LED lighting unit 118 comprises an address 120 or addressable identification (ID) which can be accessed by activating the second icon 106.

As illustrated in FIG. 1, the first icon 104 may comprise a touch array (e.g., a touch slider) where the user can slide a tip of the user's finger to set the color and/or intensity of the LED lighting unit 118. The second icon 106 may comprise a touch button representing the LED lighting unit 118, where the user can apply the color and intensity selection to the LED lighting unit 118 by pressing the touch button. It is appreciated that any type of user interfaces may be used as the input panel, which includes but not limited to a resistive touch sensing device, mechanical switches and so on, can be used instead of the capacitive touch sensing device 102. It is also appreciated that the overlay of the capacitive sensing touch pad 102 may be designed in such a way that the user can conveniently access all the lightings or LED lighting units 118 present in the building or residence via selection of other icons 107. It is further appreciated that the capacitive sensing touch pad 102 can be wall mounted or installed on a computer screen of a desktop or laptop.

The lighting control system 100 also includes a remote lighting control module 108 coupled to the capacitive sensing touch pad 102 for generating and forwarding control data 110 associated with color and intensity to the LED lighting unit 118 via a power line 114 (e.g., which comprises a path for transmission of half duplex modulated data) in response to a user's interaction with the first icon 104 and the second icon 106.

In one exemplary implementation, the remote lighting control module 108 may be implemented using a programmable electronic device. The remote lighting control module 108 include a power line transmitter module for forwarding the control data 110 to the LED lighting unit 118 via the power line 114 using a FSK modulation module, for instance. The remote lighting control module 108 may be wall mounted (e.g., in a junction box associated with the input panel).

The power line 114 may be an AC power line (e.g., 110 volts AC, 240 volts, etc.) or DC power line (e.g., 12 volts DC, 24 volts DC, etc.). In addition, the power line 114 may be a two-wire half-duplex power line. It is appreciated that the lighting control system 100 does not employ any additional wires for communicating with the LED lighting unit 118. Instead, it uses the power line 114 as the communication means as well as the power delivery medium. As illustrated in FIG. 1, the remote lighting control module 108 is coupled to the power line using a coupling circuit 112. The coupling circuit 112 may be used to couple the low voltage remote lighting control module 108 to the power line 114. It is appreciated that the capacitive sensing touch pad 102, the remote lighting control module 108 and the coupling circuit 112 may be implemented in a single device, for example, associated with a single wall mounted junction box.

Figure 3:
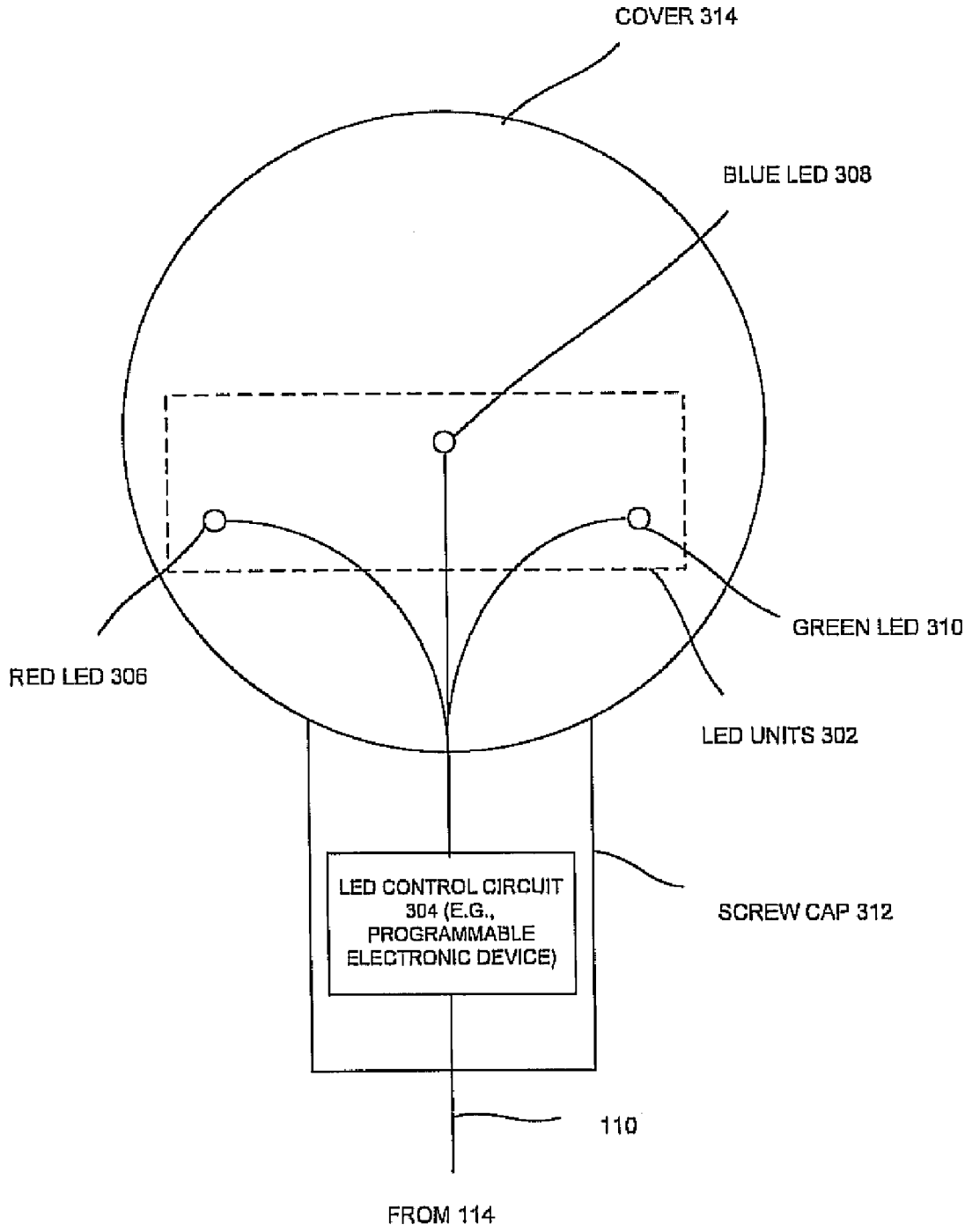
FIG. 3 illustrates an exploded view of an exemplary LED light unit, according to one embodiment.

As will be illustrated in details in FIG. 3, the LED lighting unit 118 (commonly referred as a "bulb") may comprise an LED portion for emitting light and an LED control circuit for directly setting of the color and intensity level of the LED portion based on the control data when the LED lighting unit 118 is electrically coupled to the power line 114. It is appreciated that lighting control system 100 can be adapted to control other types of lighting, such as incandescent lighting, florescent lighting, and so on.

In an alternative embodiment, the remote lighting control module 108 may control a switch that provides power for the LED lighting unit 118 rather than the LED lighting unit 118 itself. In this case, groups of lights controlled by the switch can be controlled together while the switch is addressable, not the lights themselves. In yet another alternative embodiment, the remote lighting control module 108 may control the fixture (e.g., a socket) for the LED lighting unit 118. In this case, the fixture is addressable, not the light.

Figure 2:
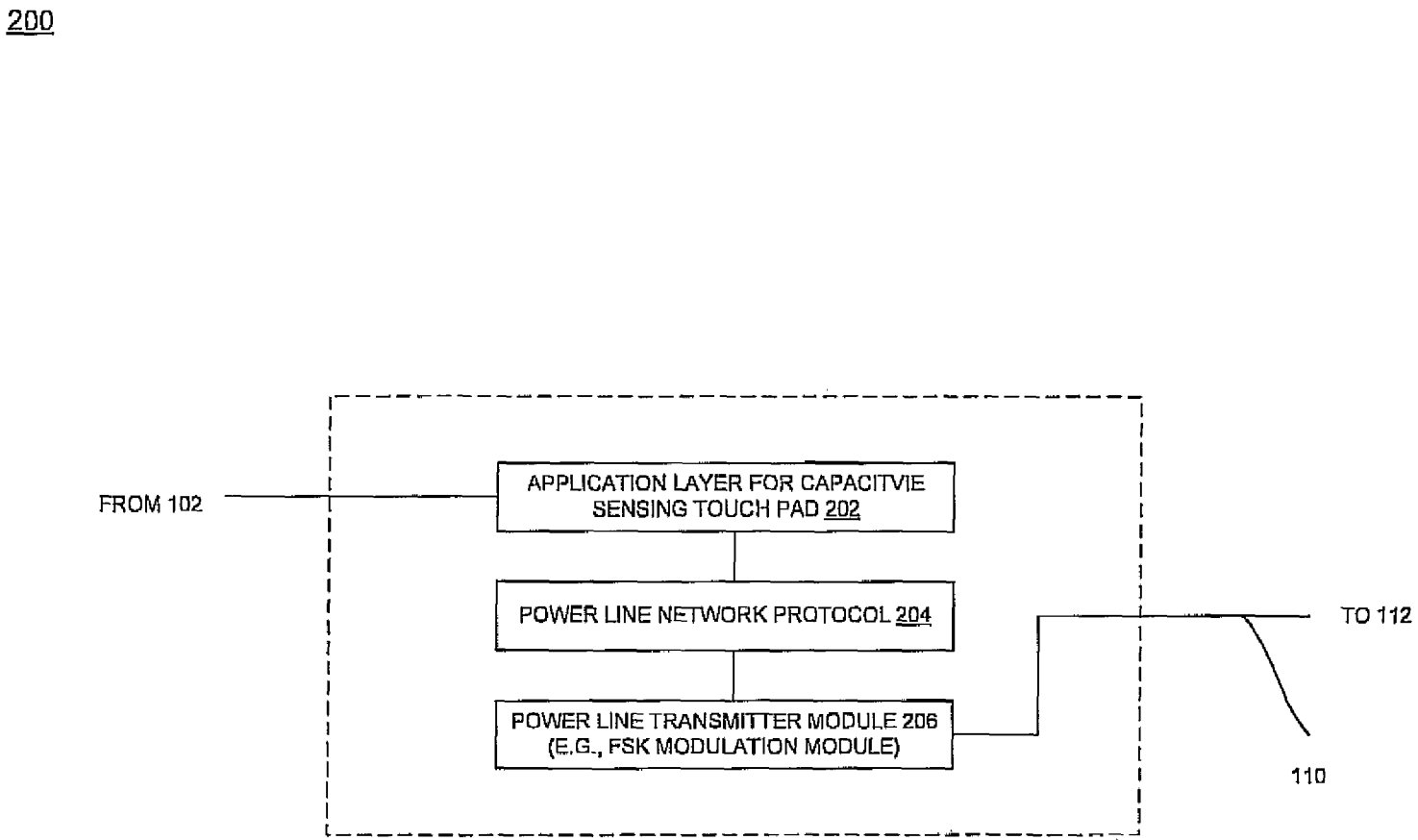
FIG. 2 illustrates an exploded view of an exemplary remote lighting control module, according to one embodiment.

FIG. 2 illustrates an exploded view of an exemplary remote lighting control module 200, according to one embodiment. It is appreciated that the remote lighting control module 200 is an exemplary embodiment of the remote lighting control module 108 of FIG. 1. In FIG. 2, the remote lighting control module 200 includes an application layer for capacitive sensing touch pad 202, a power line network protocol 204 and a power line transmitter module 206.

The application layer for capacitive sensing touch pad 202 is an application layer for processing a user's input at the capacitive sensing touch pad 102 of FIG. 1. For example, the application layer for capacitive sensing touch pad 202 may generate the control data 110 (e.g., the color and/or intensity of the LED lighting unit 118) and/or determine the address of the LED lighting unit 118 to forward the control data 110.

The power line network protocol 204 may be a software communication protocol which interfaces with the power line 114. The power line transmitter module 206 may be used to modulate packets of the control data 110 using a FSK modulation module for instance. The FSK modulation module may be built by configuring combination logic, input/output (I/O) pins and interconnects of a programmable electronic device, as will be illustrated in detail in FIG. 4. It is appreciated that one or more additional application layers for different applications may be simultaneously run by the programmable electronic device hosting the remote lighting control module 200.

In one embodiment, only the remote lighting control module 200 may be implemented by a programmable electronic device. In an alternative embodiment, the application layer capacitive sensing touch pad 202 of the remote lighting control module 200 may reside in a different programmable electronic device than the one implementing the power line network protocol 204 and the power line transmitter module 206. In the alternative embodiment, a serial interface (e.g., inter-integrated circuit (12C), serial peripheral interface and universal asynchronous receiver/transmitter (UART)) may be used to interface the two programmable electronic devices.

FIG. 3 illustrates an exploded view of an exemplary LED light unit (e.g., or device) 300, according to one embodiment. A light emitting diode (LED) device 118 of FIG. 1 is the LED light unit 300 which includes an LED portion (e.g., a red LED 306, a blue LED 308 and/or a green LED 310) for emitting color light. The LED light unit 300 comprises an LED control circuit 304 for setting color and intensity level of the LED in response to a receipt of the control data 110 via the power line 114 when the LED light unit 300 is electrically coupled to the power line 114. The LED light unit 300 further comprises a mechanism for coupling to a light fixture, for example, a screw cap 312 and a cover 314. The control data 100 may be generated in response to user input to the capacitive sensing touch pad 102 of the remote lighting control module 108 for the LED light unit 300. The LED light unit 300 may also comprise a unique address (e.g., or an identification) for control and communication therewith. This address may be associated with an icon (e.g., touch button) on the capacitive sensing touch pad which represents the LED light unit 300.

The control data 110 may comprise a data packet that includes a first intensity level of the red LED 306, a second intensity level of the blue LED 308 and a third intensity level of the green LED 310 as well as an identification of the LED light unit 300. It is appreciated that other colors may be created by combining the three LEDs. It is also appreciated that any of the primary colors may be eliminated from the lighting by setting the intensity of the corresponding LED to zero or a minimal value.

Figure 5:
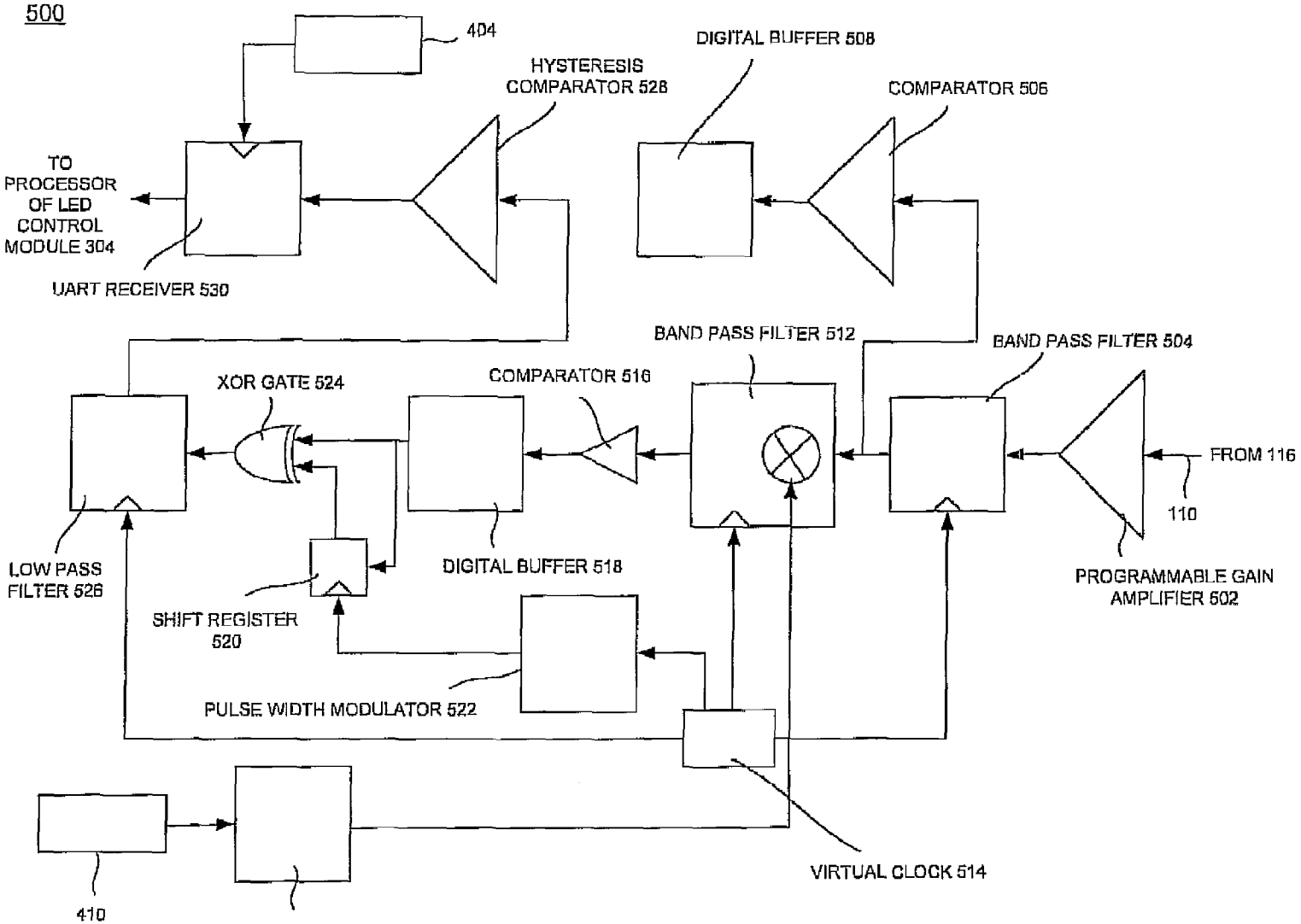
FIG. 5 is a block diagram of an exemplary FSK demodulation module, according to one embodiment.

As will be illustrated in detail in FIG. 5, the control data 110 is received and/or processed using a power line receiver module of the LED control circuit 304 of FIG. 3 based on a FSK demodulation module in one example. The LED control circuit 304 also comprises a processor for controlling the color and intensity of the LED light unit 300 based on the control data 110. In one embodiment, the LED control circuit 304 may be implemented using a programmable electronic device.

In one exemplary implementation, controlling of the color and intensity of the LED light unit 300 may be performed by varying duty cycles of pulse width modulators assigned for the three colored LEDs, respectively. During the operation, the control data 110 is used to control the pulse width modulators to flicker the LEDs to realize their respective intensities. The flickering frequencies may be greater than a human's visual perception, so the user detects steady light.

Figure 4:
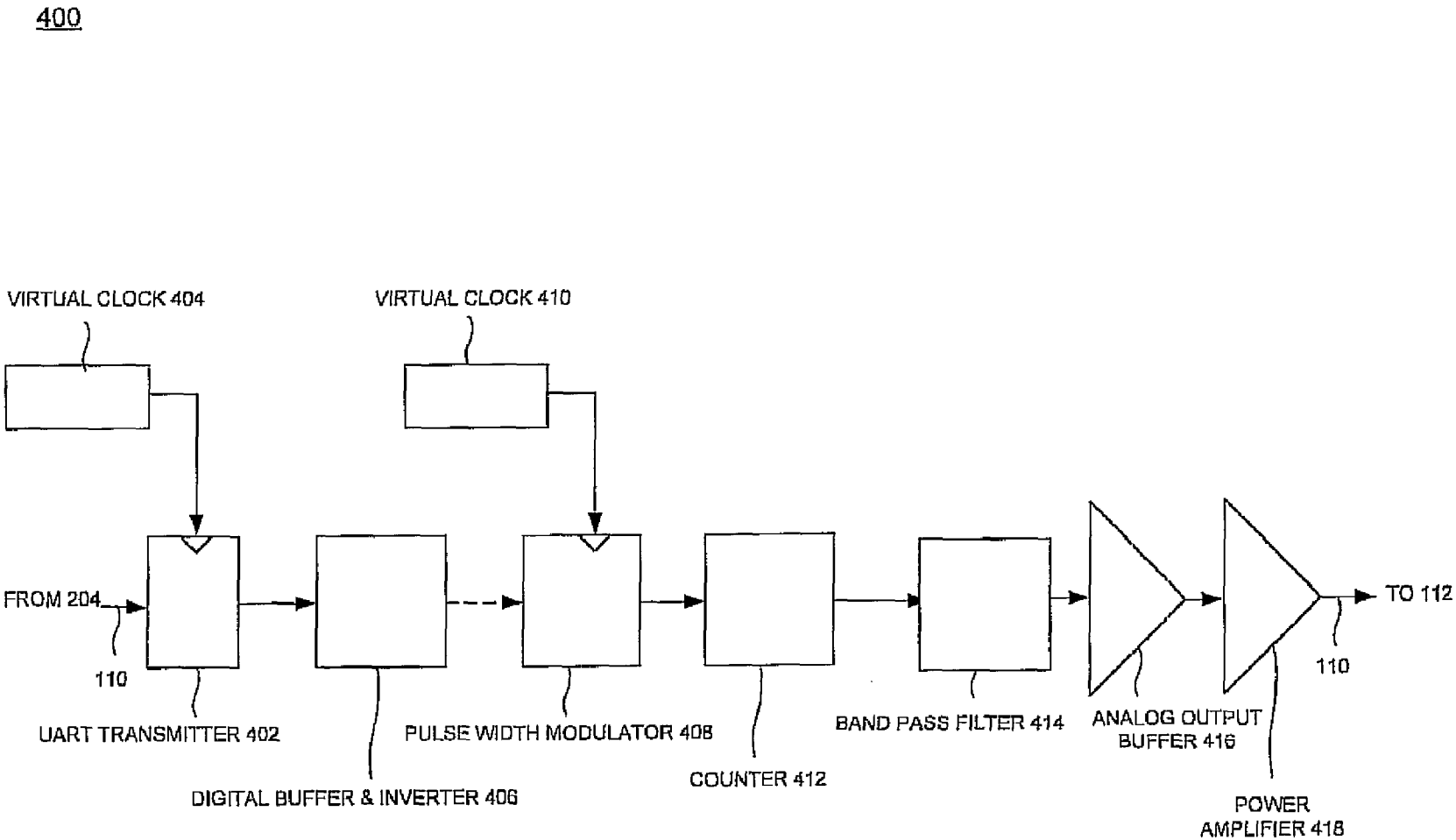
FIG. 4 is a block diagram of an exemplary frequency-shift keying (FSK) modulation module, according to one embodiment.

FIG. 4 is a block diagram of an exemplary frequency-shift keying (FSK) modulation module 400, according to one embodiment. It is appreciated that the FSK modulation module 400 (e.g., ×8) is an exemplary embodiment of the power line transmitter module 206 of FIG. 2, and may be used to transmit data over a power line. As illustrated in FIG. 4, the FSK modulation module 400 includes a universal asynchronous receiver/transmitter 402 (UART), a digital buffer and inverter 406, a pulse width modulator 408, a counter 412, a band pass filter 414, an analog output buffer 416 and a power amplifier 418 coupled in series.

The UART transmitter 402 receives the control data 110 from the network protocol stack 204 and transmits the control data 110 at 2400 baud rate in one example. The baud rate may change based on the frequency of a virtual clock 404 (e.g., 19230.8 KHz). For example, for a 1200 baud rate, the frequency of the virtual clock 404 is 1200×8 or 9600 KHz. The digital buffer and inverter 406 are used to control the pulse width modulator 408. The digital buffer and inverter 406 monitor the output of the UART transmitter 402 and change the period of the pulse width modulator 408 accordingly with interrupt routines in software.

The pulse width modulator 408 and the counter 412 are used to generate the required FSK frequencies for transmission. For example, the period of the pulse width modulator 408 is initially set to 90 for logic "1," but changes to 89 when the UART transmitter 402 transmits logic "0." Thus, the period keeps changing back and forth depending on the output of the UART transmitter 402, and the control data 110 is transmitted at the modulating frequencies. The output of the pulse width modulator 408 is fed to the counter 412 which further divides the FSK frequencies by 2 to attain the exact FSK frequencies. If the output of the counter 412 is fed directly to the power amplifier 418, many unwanted spectral components can be generated due to the frequency shifting.

The band pass filter 414 operates to fit the transmitted analog signal (e.g., the control data 110) within the slew rate limitation of the output analog buffer 416 and the power amplifier 418 of the remote lighting control module 108 to comply with the European Committee for Electro technical Standardization (CENELEC) standards or any other associated standards. The gain for the band pass filter 414 may be 0.5, and the gain for the analog output buffer 416 may be 1.0 in one example.

It is appreciated that the power line transmitter module 206 can be realized using a different modulation technique than the FSK modulation scheme. For example, a binary phase-shift keying (BPSK) modulation scheme can be used instead. It is also appreciated that the FSK modulation module 400 is one example embodiment of the power line transmitter module 206, so it can be realized using a different software and/or hardware design.

FIG. 5 is a block diagram of an exemplary FSK demodulation module 500, according to one embodiment. It is appreciated that the FSK demodulation module 500 is an exemplary embodiment of a power line receiver module for the LED control circuit 304 of FIG. 3. The control data 110 processed by the FSK demodulation module 500 is then used by a processor of the LED control circuit 304 to set the intensity of each LED unit 302 of the LED light unit 300. In one exemplary implementation, the process may configure the duty cycle of a pulse width modulator coupled to each LED unit 302 based on the control data 110.

As illustrated in FIG. 5, the FSK demodulation module 500 comprises a programmable gain amplifier 502, a band pass filter 504, a comparator 506, a digital buffer 508, a pulse width modulator 510, a band pass filter 512, a virtual clock 514, a comparator 516, a digital buffer 518, a shift register 520 (e.g., a 24 bit shift register), a pulse width modulator 522, an XOR gate 524, a low pass filter 526, a hysteresis comparator 528 and a UART receiver 530 in addition to the virtual clock 404 and the virtual clock 410 of FIG. 4.

The control data 110 via the power line 114 is received by the FSK demodulation module 500. The control data 110 is fed to the programmable gain amplifier 502 via the coupling circuit 116. The programmable gain amplifier 502 boosts the signal when the signal attenuates to a great extent due to either noise or distance.

The band pass filter 504 may be a 2-pole filter designed for 5 dB gain and centered on the geometric mean (e.g., 132.3 KHz) of the two modulating frequencies (e.g., 131.8 KHz and 133.3 KHz). The bandwidth of the filter is set somewhat wider than the frequency difference of the two frequencies. The filter may be implemented in a switched capacitor circuit, and may have a balanced gain of about 4 dB at both modulating frequencies in one example.

The band pass filter 512 implements both a heterodyne and an intermediate frequency (IF) band pass filter. The band pass filter 512 may be a 2-pole filter centered at the geometric mean (e.g., 12.5 KHz) of the two heterodyned frequencies (e.g., 11.8 KHz and 13.3 KHz). The heterodyne implementation involves feeding a 120 KHz square wave into the band pass filter 512, where the 120 KHz square wave may be generated by the pulse width modulator 510. The sine wave out of the band pass filter 512 is fed to the comparator 506 which enables monitoring of the signal level and the state of the channel. If the signal level is beyond a threshold level, the comparator 506 sets up an interrupt routine in the digital buffer to indicate that the band is in use. A transmitter module associated with the FSK demodulation module 500 may check the digital buffer 508 to see whether it is cleared to transmit.

The output from the band pass filter 512 may be fed to a correlator which includes the comparator 516, the digital buffer 518, the shift register 520, the XOR gate 524, the low pass filter 526 and the hysteresis comparator 528. The correlator detects FSK waveforms by multiplying the signal (e.g., the control data 110) by a delayed replica of itself. The product of the waveforms at the two signaling frequencies is a DC signal where the level and polarity is a function of the delay. For example, for a certain delay selected, the correlator can detect 1's and 0's. It is appreciated that the correlator is more robust than using a pair of narrow-band filters when the levels of the two signaling frequencies are unknown or unequal.

Additionally, the correlator can be implemented using a programmable electronic device without the use of gain control circuits. The output of the hysteresis comparator 528 is fed to the UART receiver 530 which may be configured at 2400 baud rate for instance. Then, the output of the UART receiver 530 (e.g., the control data 110) is fed to the processor of the LED control circuit 304 to set the intensity of the LED light unit 300.

It is appreciated that the power line receiver module can be realized using a different modulation technique than the FSK demodulation scheme. For example, a binary phase-shift keying (BPSK) demodulation scheme can be used instead. It is also appreciated that the FSK demodulation module 500 is one example embodiment of the power line receiver module, so it can be realized using a different software and/or hardware design.

Figure 6:
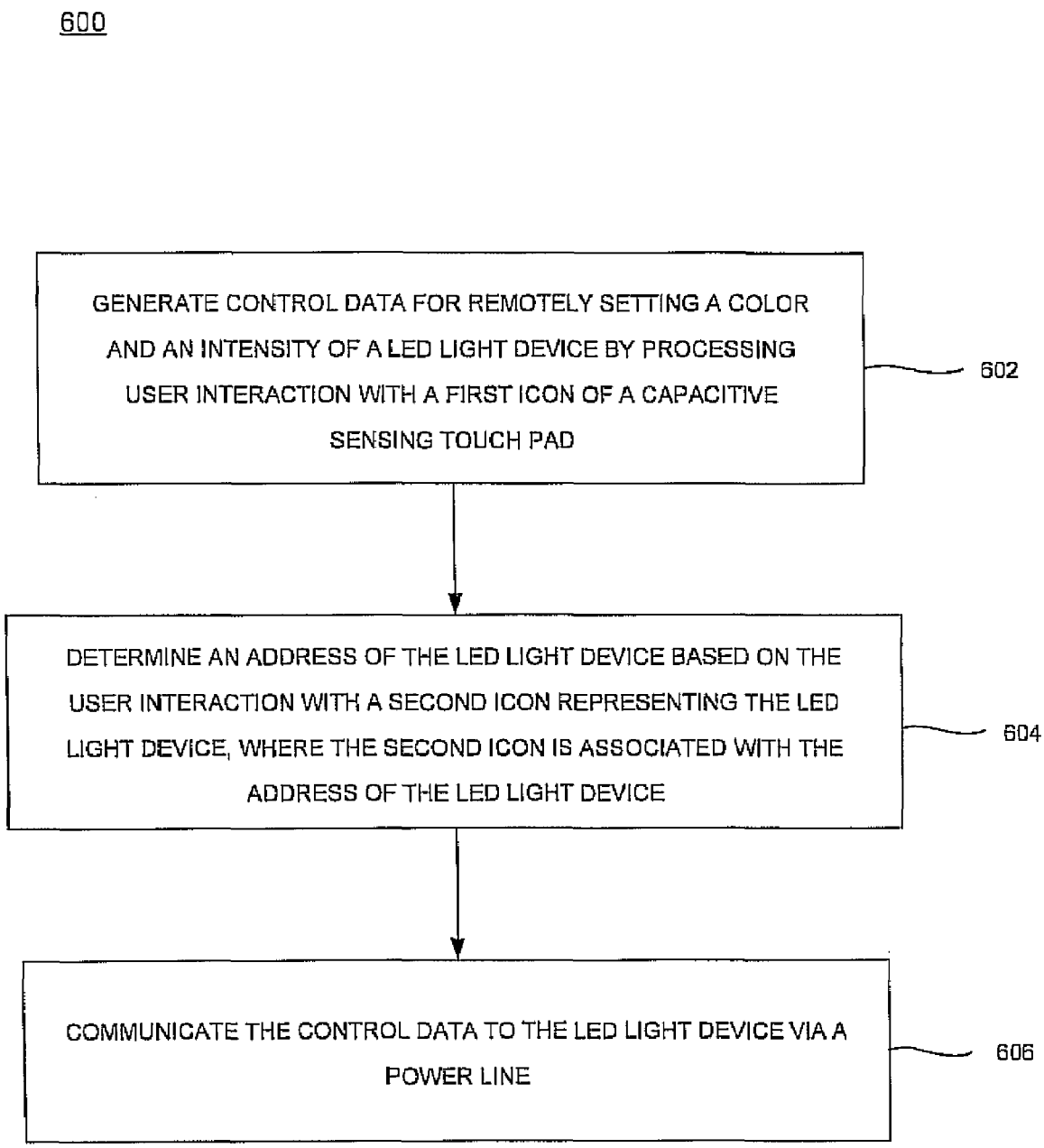
FIG. 6 is a process flow chart of an exemplary method for remotely controlling an addressable LED light bulb, according to one embodiment.

FIG. 6 is a process flow chart of an exemplary method for remotely controlling an addressable LED light device, according to one embodiment. In operation 602, control data for setting a color and an intensity of an LED light device is generated by processing a user's interaction with a first icon (e.g., a touch array) of a capacitive sensing touch pad. In one embodiment, the LED light device comprises an LED light control circuit for setting the color and the intensity level of the LED light device based on the control data received via a power line when the LED light device is electrically coupled to the power line, for example, connected to a powered light fixture.

In operation 604, an address of the LED light device is determined based on the user's interaction with a second icon (e.g., a touch button) representing the LED light device, where the second icon is operable for identifying the address of the LED light device. In operation 606, the control data is communicated to the LED light device via the power line, wherein the control data may be transmitted via the power line using a FSK modulation module in one embodiment. At operation 606, an LED control circuit of the LED light device receives the control data, recognizes that the data is for the device according to the address, and applies the color intensity data to an LED portion to effectuate the desired color and intensity as input at the remote control panel.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A light device, comprising:

a first light source;

a mechanism to couple the first light source to a light fixture;

a control circuit to set an intensity level of the first light source in response to receipt of control data transmitted via a power line; and a user interface of a remote lighting control module for the first light source in communication with the control circuit, the user interface including a first icon and other icons;

wherein:

the control data is generated in response to user input to the user interface of the remote lighting control module for the first light source, the first light source comprises a unique address associated with the first icon on the user interface, and the other icons of the user interface are associated with lighting units other than the first light source and are configured for accessing the lighting units.

2. The device of claim 1, wherein the first light source comprises a plurality light emitting diodes (LEDs) including a red LED, a blue LED and a green LED.

3. The device of claim 2, wherein the control data comprises a first intensity level of the red LED, a second intensity level of the blue LED and a third intensity level of the green LED.

4. The device of claim 1, wherein the control circuit is operable to receive control data communicated via the power line using frequency-shift keying (FSK) modulation, and wherein the control circuit comprises a power line receiver module to receive the control data based on the FSK demodulation.

5. The device of claim 1, wherein the user interface comprises a capacitive sensing touch pad.

6. The device of claim 1, wherein the control circuit comprises a processor to control the intensity of the first light source based on the control data.

7. The device of claim 1, wherein the mechanism to couple the first light source to the light fixture is operable to be coupled to the power line.

8. The device of claim 1, wherein the control circuit is implemented using a programmable electronic device.

9. A lighting control system, comprising:

a capacitive sensing touch pad comprising a first button operable to remotely set color and intensity, a second button representing a first LED light device, and other buttons associated with other LED lighting units, wherein the first LED light device comprises an address linked with the second button, and selection of the other buttons accesses the other LED lighting units; and a remote lighting control module coupled to the capacitive sensing touch pad to generate and forward the address and control data associated with the color and the intensity information to the LED light device via a power line in response to user interaction with the first button and the second button to remotely control the LED light device.

10. The system of claim 9, wherein the first LED light device comprises:

an LED to emit light; and a control circuit to set the color and intensity level of the LED based on the control data.

11. The system of claim 10, wherein the control circuit comprises a receiver module to receive the control data from the power line.

12. The system of claim 9, wherein the power line comprises a path to transmit half duplex modulated data.

13. The system of claim 9, wherein the remote lighting control module is wall mounted and is implemented using a programmable electronic device.

14. The system of claim 9, wherein the remote lighting control module comprises a power line transmitter module to couple with a power line and to forward the control data to the LED light device via the power line using FSK modulation.

15. The system of claim 9, wherein the first button comprises a touch array.

16. The system of claim 15, wherein the second button comprises a touch button.

17. A method for remotely controlling an LED light device via a power line, comprising:

generating control data to set color and intensity information by processing user interaction with a first icon of a capacitive sensing touch pad;

determining an address of the LED light device based on the user interaction with a second icon representing the LED light device, wherein the second icon is associated with the address of the LED light device;

communicating the address and control data to the LED light device via the power line; and accessing lighting units other than the LED light device based on the user interaction with other icons of the capacitive sensing touch pad other than the first icon and the second icon.

18. The method of claim 17, wherein the first icon comprises a touch array and the second icon comprises a touch button.

19. The method of claim 17, wherein the communicating the address and control data to the LED light device comprises transmitting the address and the control data via the power line using FSK modulation.

20. The method of claim 17, wherein the LED light device comprises a light source and a control circuit to set color and intensity level of the light source based on the control data, and wherein the control circuit controls color and intensity of the light source responsive to the address and the control data.

* * * * *